US009435602B1

(12) United States Patent
Tomik et al.

(10) Patent No.: US 9,435,602 B1
(45) Date of Patent: Sep. 6, 2016

(54) ACTIVE RECOIL CONTROL SYSTEM

(71) Applicants: Matthew Tomik, Easton, PA (US); William Bartell, Hackettstown, NJ (US); Thomas Tighe, Morristown, NJ (US); Noah Gordon, Metuchen, NJ (US); Joshua Stapp, Mt. Bethel, PA (US)

(72) Inventors: Matthew Tomik, Easton, PA (US); William Bartell, Hackettstown, NJ (US); Thomas Tighe, Morristown, NJ (US); Noah Gordon, Metuchen, NJ (US); Joshua Stapp, Mt. Bethel, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/596,573

(22) Filed: Jan. 14, 2015

(51) Int. Cl.
*F41A 25/10* (2006.01)

(52) U.S. Cl.
CPC ..... *F41A 25/10* (2013.01)

(58) Field of Classification Search
CPC ..... F41A 25/00; F41A 25/02; F41A 25/04; F41A 25/06; F41A 25/08; F41A 25/10; F41A 25/12; F41A 25/14; F41A 25/16; F41A 25/18; F41A 25/20; F41A 25/22; F41A 25/24
USPC ..... 89/42.01, 42.02, 42.036, 43.01, 43.02, 89/44.01, 44.02
See application file for complete search history.

(56) References Cited

U.S. PATENT DOCUMENTS

| | | | | | |
|---|---|---|---|---|---|
| 3,017,807 | A * | 1/1962 | Grover | F15B 15/12 | 188/134 |
| 3,795,998 | A * | 3/1974 | Kuhl | C06F 1/08 | 42/74 |
| 4,046,056 | A * | 9/1977 | Carrie | F41A 7/04 | 89/1.4 |
| 4,072,082 | A * | 2/1978 | Bates | F41A 9/51 | 89/162 |
| 4,924,752 | A * | 5/1990 | Tassie | F41F 1/10 | 89/12 |
| 5,127,309 | A * | 7/1992 | Menges | F41A 17/18 | 89/11 |
| 5,152,724 | A * | 10/1992 | Scheiber | B60T 1/062 | 188/264 E |
| 8,297,174 | B1 * | 10/2012 | Russell | F41A 25/12 | 89/37.14 |
| 2010/0269679 | A1 * | 10/2010 | Fisk | F41A 25/08 | 89/37.11 |

* cited by examiner

*Primary Examiner* — Bret Hayes
(74) *Attorney, Agent, or Firm* — Michael C. Sachs

(57) ABSTRACT

An active recoil control system uses multiple sensors in combination with a solenoid controlled multi-disc brake to adjust the weapon recoil. Using outputs from the sensors, a controller predicts and reacts to a recoiling mass performance, and applies the required braking force, in order to compensate for anticipated or actual variations. Feedback from the sensors allows the active recoil control system to adjust braking during the recoil strokes and counter-recoil strokes in order to optimize the weapon operation and performance in extreme firing conditions.

11 Claims, 13 Drawing Sheets

ACTIVE RECOIL CONTROL SYSTEM

GOVERNMENTAL INTEREST

The invention described herein may be manufactured and used by, or for the Government of the United States for governmental purposes without the payment of any royalties thereon.

FIELD OF THE INVENTION

The present invention relates in general to the field of weapons. Specifically, this invention relates to an active recoil control system that provides braking control based on the recoil weapon parameters and performance. More particularly, the present invention is capable of adjusting the damping force of a mechanical recoil brake during recoil and counter-recoil strokes, in order to efficiently handle extreme firing conditions and the firing of multiple charges without hardware change.

BACKGROUND OF THE INVENTION

In a soft recoil weapon system, a recoiling mass generally refers to the components that move in response to the firing energy and may encompass, for example, a breech or a ramming mechanism, recoil cylinders, recoil springs, and firing mechanism. The rearward impulse of firing the weapon is partially cancelled by the forward momentum of the recoiling mass at the time of firing.

The recoiling mass is normally held out-of-battery by a latch mechanism against a series of compression springs. When the latch mechanism is released, the recoiling mass is accelerated forward by the compression springs (called the counter-recoil stroke). The pressure created by the ignition of the propellant gases will launch the projectile forward and will launch the recoiling mass rearward, against the force created by the compression springs (called the recoil stroke).

When designing a soft-recoil system a balance is sought between the forward momentum of the recoil system and the firing impulse, to ensure that the round fires and the weapon relatches, while minimizing recoil forces. Since the weapon must perform under a variety of conditions, including variations in ambient temperatures and propellant performance as well as weapon orientations (quadrant elevations) and platform cants (slopes), it becomes necessary to compensate for these variations, in order to ensure latching and to minimize recoil loads.

Conventionally, hydro-pneumatic recoil systems are utilized on large-caliber weapons to accomplish this task, while small caliber systems utilize ring springs.

The need to maintain relatively low recoiling loads so that the weapons can be mounted onto light mobile platforms, is further complicated by other factors. These factors include for example, ignition delays, the ability to react to abnormally high impulses, the ability to perform at greater temperature extremes, and the ability to perform at greater weapon cant.

Ignition delays may, in extreme cases, defeat the advantages of soft recoil. For instance, by the time the mortar cartridge ignites, the forward momentum of the recoiling mass is reduced to zero. In this case, the recoil forces increase significantly, making the weapon system less practical for light mobile platforms. Certain conventional weapons have addressed this problem by allowing the combustion gases to vent past the breech seal, thereby reducing the rearward momentum. However, this arrangement may reduce the muzzle velocity of the projectile.

Weapons must also be designed to withstand the largest expected chamber pressure for safe operation under the most extreme operating conditions. This pressure, known as the PMP (permissible individual maximum pressure) may be typically as high as 50% greater than ambient temperature firing pressures. Statistically, these conditions may arise 3 times per 10,000 rounds fired, but result in greatly increased recoil forces. The traditional method of addressing this concern is to either increase the recoil distance to keep the forces to an acceptable level, or to design larger, more durable components.

Additionally, mobile platforms must be able to engage a variety of targets under various environmental extremes, with increased quadrant elevation ranges, and be able to fire at a variety of platform orientations and cants. These factors tend to require reducing the forward momentum of the recoiling parts in order to guarantee latching, which in turn results in higher recoiling forces.

Conventional soft recoil weapon systems are faced with the problem of actively controlling the recoil velocity to compensate for atypical or extreme firing conditions, such as firing at temperature extremes, firing on severe cants, or when firing results in a late ignition. Variations in the conditions of the soft recoil systems can result in system malfunction or even failure.

The prominent issue with these conditions is that soft recoil systems are dependent on timing and load balances. More specifically, situational firing conditions can cause the following recoil extremes:

1—the recoiling parts do not have sufficient velocity to re-latch after firing, requiring the user to re-cock the weapon.

2—the recoiling parts have excessive velocity, causing high recoil forces and/or weapon damage.

While the conventional methods provided a certain level of control to the soft recoil weapon systems, there still remains a need for a more efficient active recoil control system that provides braking control based on the recoil weapon parameters and performance. More particularly, the active recoil control system should be capable of adjusting the damping force of a mechanical recoil brake during recoil and counter-recoil strokes in order to permit effective weapon operation in extreme firing conditions.

SUMMARY OF THE INVENTION

The present invention addresses the foregoing concerns and presents a new active recoil control system that uses multiple sensors in combination with a solenoid controlled multi-disc brake, to adjust the weapon recoil. Using outputs from these sensors, the controller is able to both predict and react to the recoiling mass performance, and to apply the required braking force, in order to compensate for anticipated or actual variations.

Feedback from the sensors allows the active recoil control system to adjust braking during the recoil strokes and counter-recoil strokes in order to optimize the weapon operation and performance in extreme firing conditions. The active recoil control system is able to eliminate the two major performance and design issues associated with soft recoil weapons, namely failure to latch and managing excess firing loads.

Under certain conditions, such as late ignition or PMP rounds, the rearward recoil velocities may be too high causing the recoil stroke to bottom out and damage weapon components. In these circumstances, the controller would apply braking force during the recoil stroke to slow down the recoiling mass and prevent the system from bottoming out.

Under certain conditions, such as extreme cold or firing on a downhill, the firing impulse may not be large enough to make the gun recoil all the way back to latch. In these circumstances, the active recoil brake would be used to apply braking force during the counter-recoil stroke so that the firing impulse would be sufficient to return the gun to the latched position.

The recoil brake is a multi disc friction brake that utilizes a stack of rotors and stators to provide a braking (or damping) load to the recoiling mass. It is configured to be a "normally on" system so that energy must be applied to the system to turn the brake off. The purpose of this is to both act as a safety and provide a more consistent brake force. According to another embodiment of the present invention, the recoil brake inverts the solenoid in conjunction with the addition of a lever mechanism. The functionality is essentially the same, however inversion of the solenoid in combination with the lever mechanism permits a higher braking force.

BRIEF DESCRIPTION OF THE DRAWINGS

The accompanying drawings, which are incorporated in, and constitute part of this specification, illustrate embodiments of the invention and together with the description, serve to explain the principles of the invention. The embodiments illustrated herein are presently preferred, it being understood, however, that the present invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figures 1A, 1B, 1C, 1D:
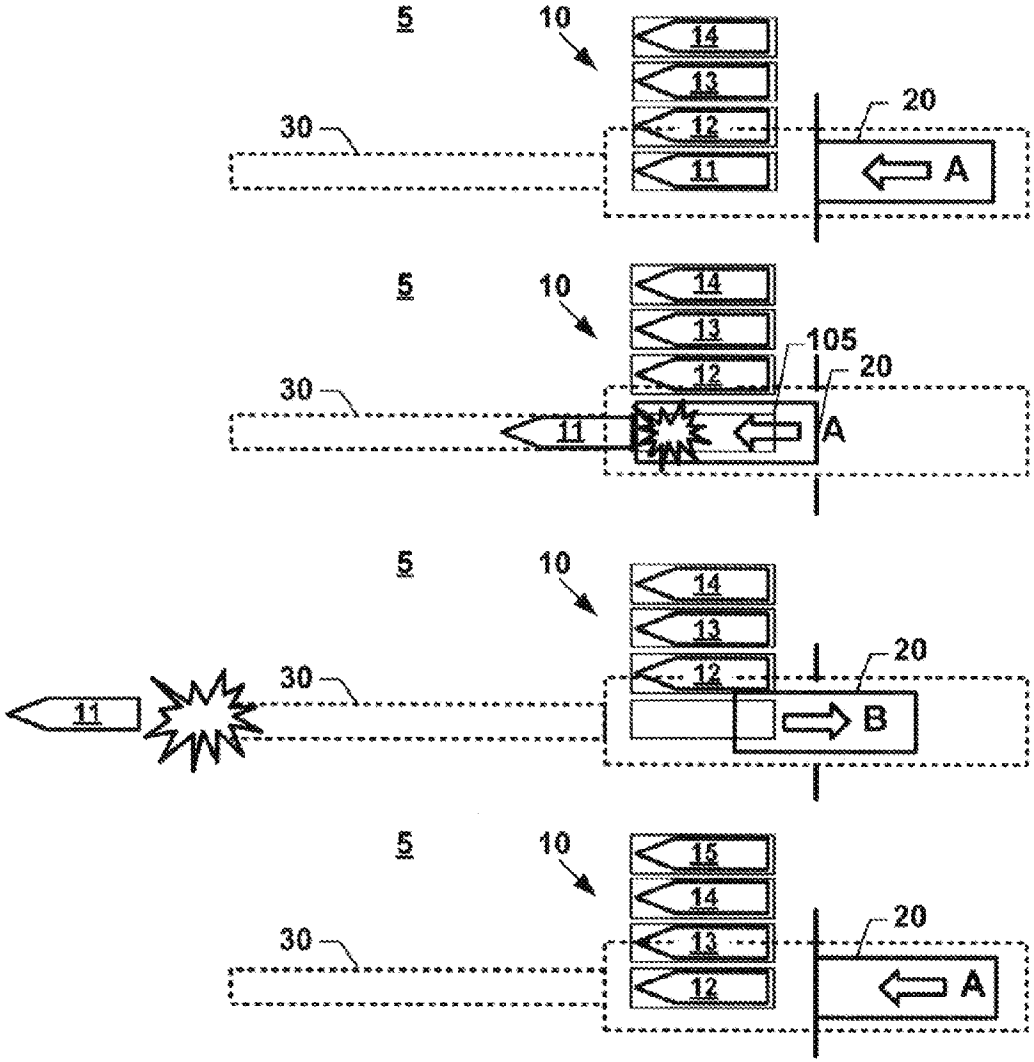
FIG. 1 includes FIGS. 1A, 1B, 1C, and 1D, and represents a schematic view of the operation of an automated weapon that is provided with an active recoil control system according to a preferred embodiment of the present invention.
Figure 2:
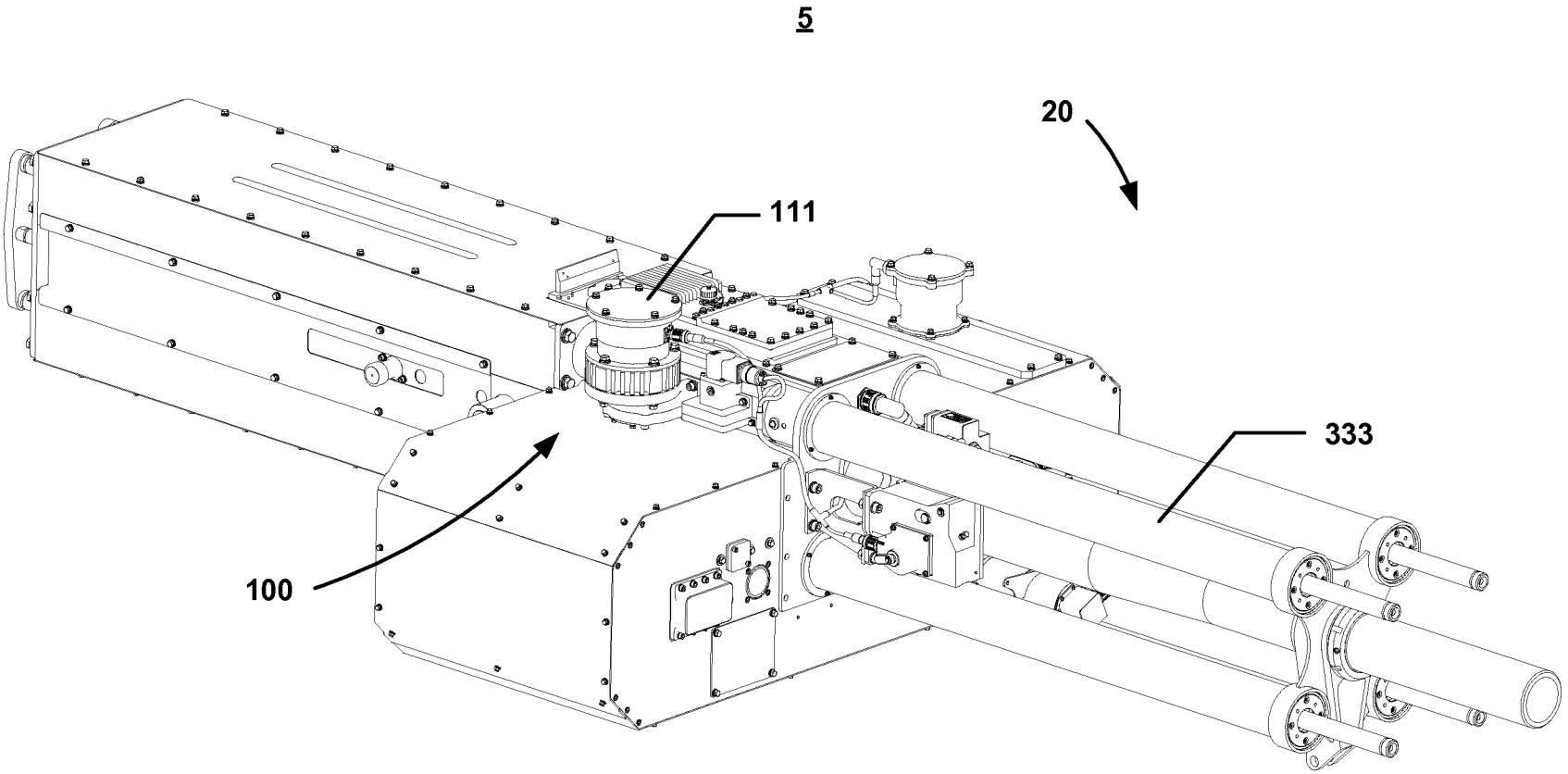
FIG. 2 is an isometric perspective view of an exemplary automated weapon system, illustrating the active recoil control system mounted thereon, for adjusting the damping force of a recoil brake during recoil and counter-recoil strokes.

With reference to FIGS. 1 and 2, they illustrate an exemplary automated weapon 5 that is provided with an active recoil control system 100, according to a preferred embodiment of the present invention. In this example, the automated weapon 5 includes an ammunition feeding mechanism 10, a gun tube 30, and a recoiling mass 20 that translates back and forth.

While the ammunition feeding mechanism 10 is shown as including four rounds 11, 12, 13, and 14, it should be clear that the ammunition feeding mechanism 10 can be provided with a different number of rounds, wherein each round, e.g., 11, 12, may be respectively stored in a storage cell, e.g., 105, as described in co-pending U.S. patent application Ser. No. 14/596,422, titled "Mortar Retention System For Automated Weapons," which is concurrently filed with the present application, and which is incorporated herein by reference in its entirety.

The general operation of the automated weapon 5 will now be described in connection with FIGS. 1A through 1D. FIG. 1A shows the first round 11 being chambered, and the recoiling mass 20 being cocked and latched. FIG. 1B shows the recoiling mass 20 unlatched and ramming the first round 11 forward, along the arrow A, causing the first round 11 to be fired through the gun tube 30. FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. FIG. 1D illustrates the recoiling mass 20 latched, with the ammunition feeding mechanism 10 indexed to the next round 12.

Figure 11:
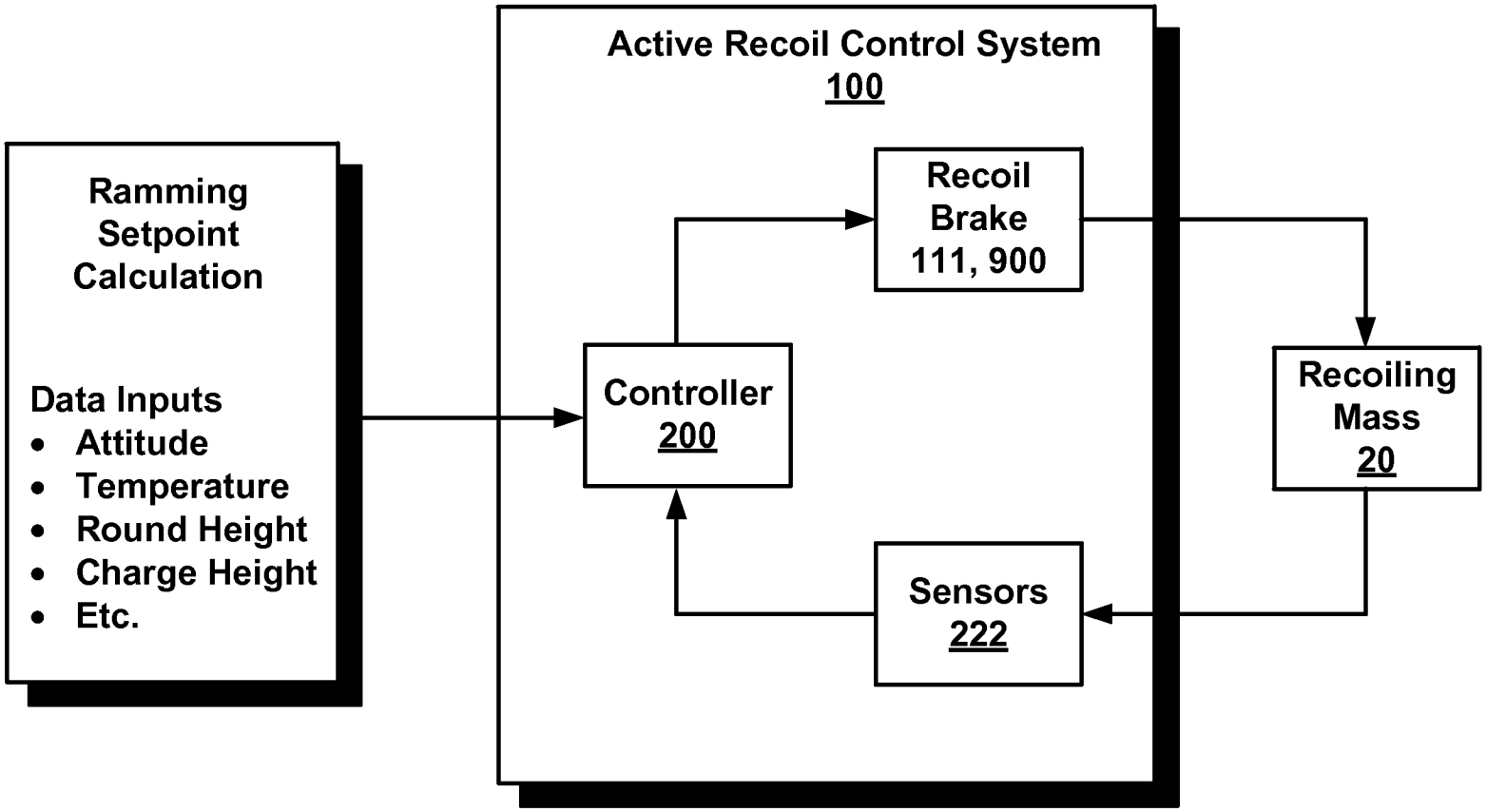
FIG. 11 is a high level block diagram of the operation of the active recoil control system of FIG. 4.

FIG. 11 illustrates the active recoil control system 100 of the present invention, with FIG. 2 illustrating the recoil brake 111 mounted on the gun cradle, and interfacing with the recoiling mass 20. As further illustrated in FIG. 11, the active recoil control system 100 is generally comprised of the recoil brake 111 that interfaces with the recoiling mass 20, a controller 200, and a plurality of sensors 222. The operation of the active recoil control system 100 will be described later in more details.

Figure 3:
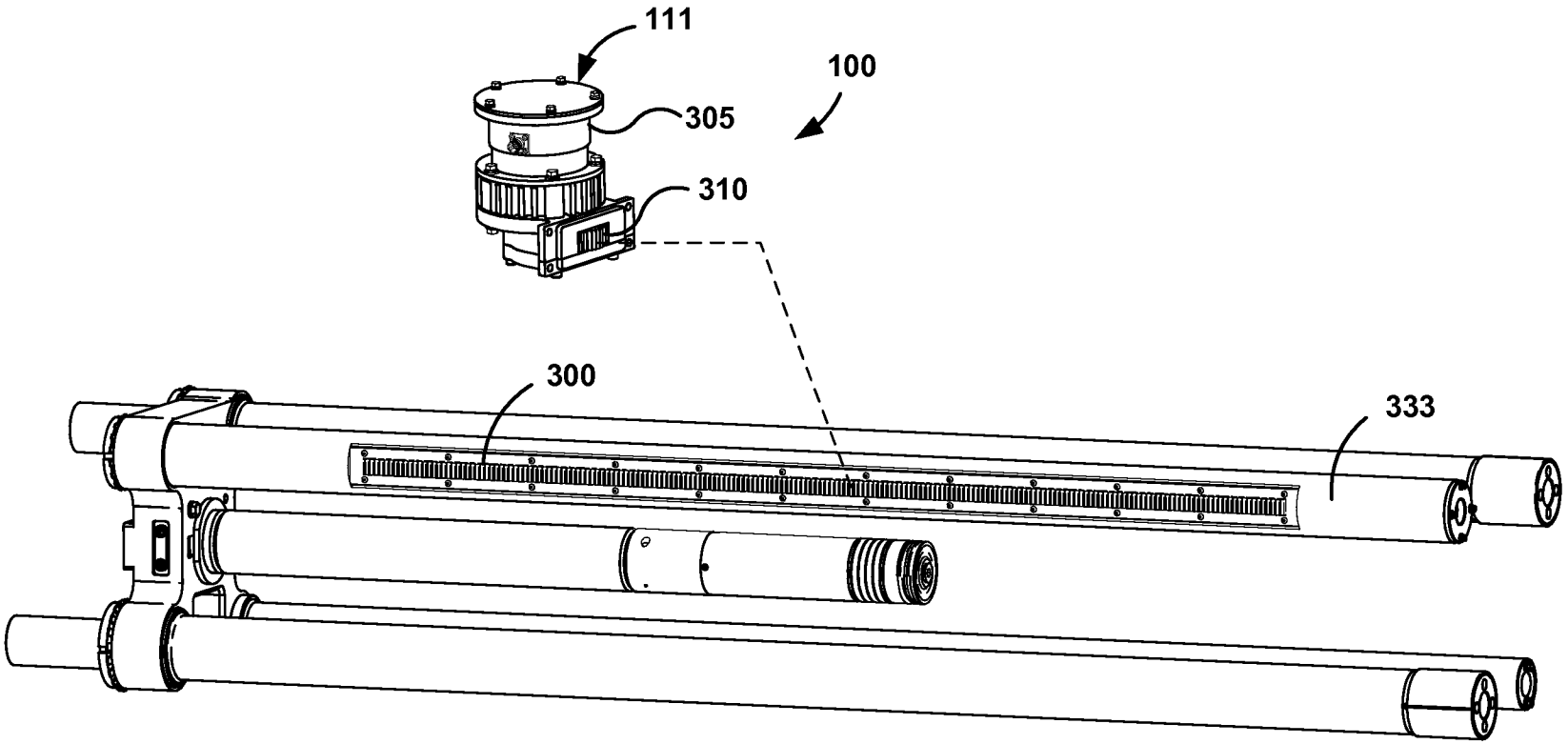
FIG. 3 is an isometric perspective view of the recoil brake that forms part of the active recoil control system of FIG. 2, further illustrating a rack gear that interfaces with the recoil brake and that is disposed on a recoiling mass of the weapon.

FIG. 3 further illustrates the recoil brake 111 interfacing with the recoiling mass 20 by means of a rack gear 300 that is formed on a recoil cylinder 333 of the recoiling mass 20. The recoil cylinder 333 is part of a specialized recoil system whose operation and functions are described in co-pending U.S. patent application Ser. No. 14/596,662 filed on Jan. 14, 2015, titled "Bi-Directional Recoil Containment and Double Strike Prevention System," which is concurrently filed with the present application, and which is incorporated herein by reference in its entirety.

While FIG. 3 illustrates the recoiling mass 20 as being controlled by only one recoil brake 111, it should be abundantly clear that more than one recoil brake 111 may be used as part of the active recoil control system 100. In addition, while the recoil brake 111 is described in connection with a weapon for illustration purpose only, it should be amply clear that the present invention is not limited to soft recoil mechanisms or weapons, and that an exemplary soft recoil weapon is presented herein for illustration purpose and does not purport to be the exclusive embodiment covered by the present invention. The recoil brake 111 may form part of a braking system in numerous other military and commercial applications, including but not limited to vehicular braking systems.

Furthermore, while the recoil brake 111 is described as interfacing with the rack gear 300 that is formed on the recoil cylinder 333, it should be clear that the rack gear 300 may be formed on, or secured to any suitable component of the recoiling mass 20. The main function of the rack gear 300 is to enable the recoil brake 111 to regulate or limit the linear recoil or counter-recoil strokes of the recoil cylinder 333 and ultimately those of the recoiling mass 20. Consequently, the rack gear 300 may be substituted with any suitable, known or available device that provides a similar or equivalent function.

In general, the recoil brake 111 includes a housing assembly 305 that provides the interface for mounting the recoil brake 111 onto a stationary component of the weapon 5. An idler gear 310 meshes with the rack gear 300 for selectively transmitting a calibrated braking torque from the recoil brake 111 to the recoiling mass 20.

In accordance with the present invention, the rack gear 300, which is affixed to the recoiling mass 20, moves linearly when the weapon 5 is fired. The recoil brake 111, which is secured to the weapon cradle, remains stationary. The effect is the motion of the recoil cylinder 333 causes the idler gear 310 to spin. The rotation of the idler gear 310 causes a brake shaft 565 to rotate as well. This is how the application of a torque on the brake shaft 565 is translated into a linear force on the recoiling components. Under normal circumstances, when the weapon 5 is fired, the solenoid 555 is activated, causing only the torque due to gravity of the disc assembly 550 to be transmitted to the recoiling mass 20. This is achieved by activating the solenoid 555, which opposes the wave spring 540.

Under certain conditions, when the controller 200 determines that the recoil velocity of the rack gear 300 requires adjustment, it instructs the recoil brake 111 to apply the appropriate recoil braking force onto the rack gear 300 to resist excess recoil translation movement of the rack gear 300.

Similarly, the controller 200 is also capable of instructing the recoil brake 111 to apply the appropriate counter recoil braking force onto the rack gear 300.

Figure 4:
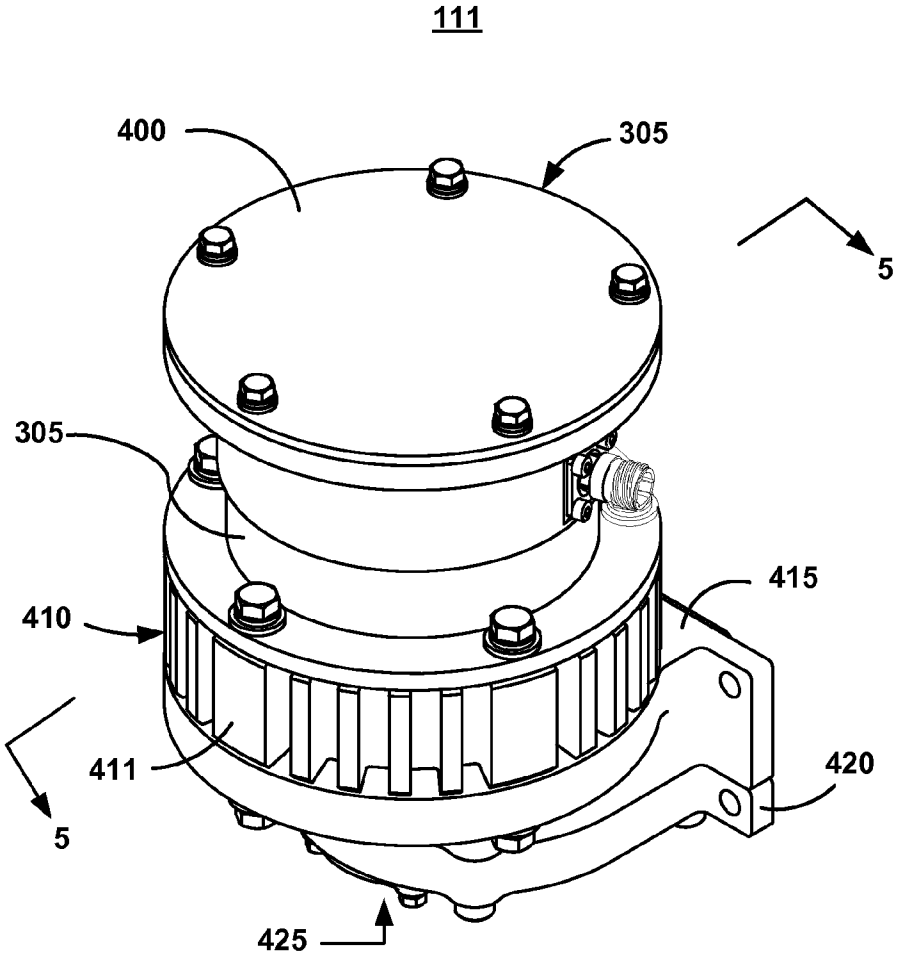
FIG. 4 is an enlarged, isometric perspective view of the recoil brake of FIG. 3.
Figure 5:
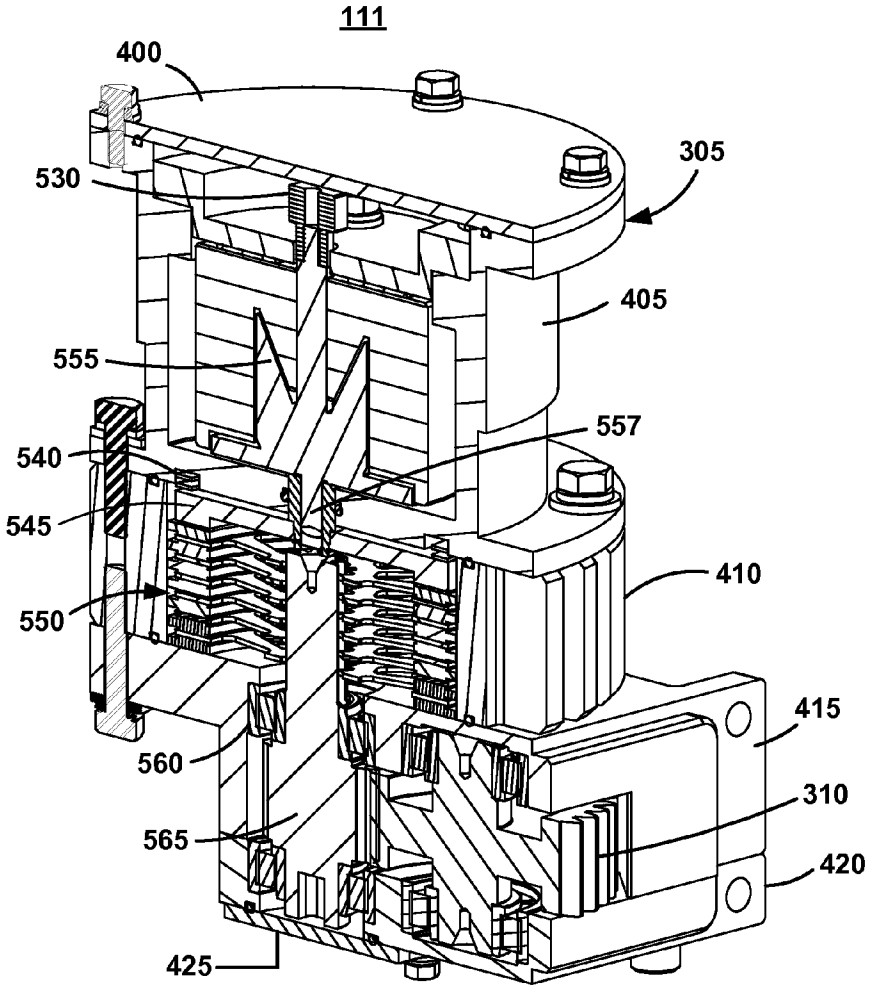
FIG. 5 is a cross-sectional view of the recoil brake of FIG. 4, taken along line 5-5 thereof.
Figure 6:
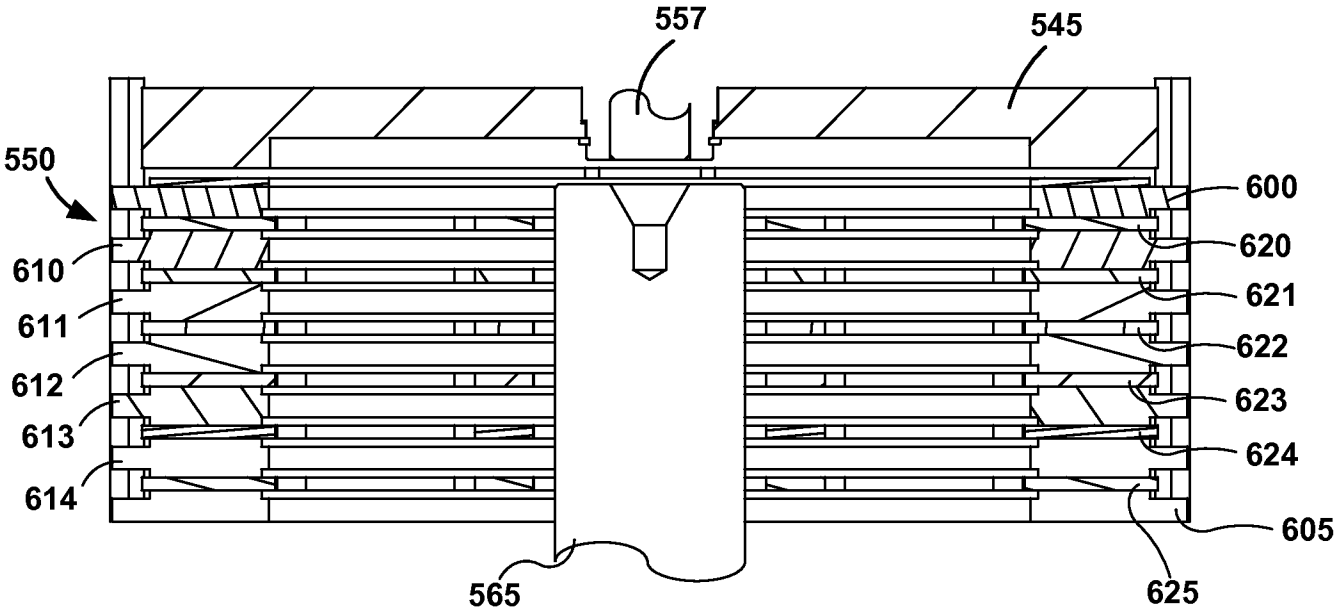
FIG. 6 is a greatly enlarged cross-sectional view of a friction disc assembly that forms part of the recoil brake of FIGS. 4 and 5.

FIGS. 4, 5, and 6 illustrate the recoil brake 111 in more detail. FIG. 4 illustrates the housing assembly 305 as comprising: a housing cover 400 that is secured to a solenoid housing 405, which, in turn is secured to a disc housing 410. An upper housing 415 is secured to the disc housing 410 at one end and to a lower housing 420 at its other end. A torque access cover 425 covers the lower housing 420 and provides an access point to enable the use of a torque wrench to check the brake torque.

In general, the housing assembly 305 provides environmental protection to the recoil brake 111 and further provides means for securing the recoil brake 111 to the weapon 5. The disc housing 410 includes a heat dissipation element 411 (FIG. 4).

As further illustrated in FIG. 5, the solenoid housing 405 houses an override nut 530 and a solenoid 555. The disc housing 410 houses a wave spring 540, a pressure plate 545, and a disc assembly 550. The override nut 530 enables the performance of maintenance on the recoil brake 111. It provides manual override of the recoil brake 111 by opposing a force generated by the wave spring 540, without the use of the solenoid 555.

One side of the wave spring 540 engages and presses against the bottom side of the solenoid housing 405, while its other side presses against the pressure plate 545. In turn, the pressure plate 545 engages a solenoid plunger 557 and abuts against the disc assembly 550.

The upper housing 415 and the lower housing 420 house bearings 560, the idler gear 310, and a brake shaft 565. The upper and lower housings 415, 420 provide the interface for mounting the disc assembly 550 to the weapon 5. As described earlier, the idler gear 310 meshes with the rack gear 300 on one of the recoil cylinder 333 and transmits the braking torque from the brake shaft 565 to the recoiling mass 20.

As further illustrated in FIG. 6, the disc assembly 550 is formed of a plurality of interlaced discs that convert the axial force applied by the wave spring 540 into a torque applied to the brake shaft 565. The disc assembly includes two endors 600, 605; a plurality of stators (e.g., 5 stators) 610, 611, 612, 613, 614; and a plurality of rotors (e.g., 6 rotors) 620, 621, 622, 623, 624, 625.

The endors 600, 605 and the stators 610, 611, 612, 613, 614 are securely keyed to the disc housing 410 and are stationary. The rotors 620, 621, 622, 623, 624, 625 are interlaced between the endors 600, 605 and the stators 610, 611, 612, 613, 614, and rotate with the brake shaft 565. Each rotor, e.g., 620, is forced to rotate with the brake shaft 565 via a spline connection. Braking is achieved by the interaction of the rotors 620-625 (that rotate with the brake shaft 565) and the stators 610-614 (that are stationary and fixed to the housing 305).

The wave spring 540 applies a force to the pressure plate 545. In the normal position, the pressure plate 545 transmits the wave spring (540) force directly to the disc assembly 550, causing the multi-disc recoil brake 111 to apply a braking (or damping) force to the recoiling mass 20. The solenoid 555 is used to oppose the wave spring (540) force on the pressure plate 545 and to relieve the force transmitted to the disc assembly 550. Consequently, activating the solenoid 555 allows the brake shaft 565 to spin freely except for the frictional forces due to gravity.

In summary, when the recoiling mass 20 is moving, it causes the rack gear 300 to translate, which causes the idler gear 310 and the brake shaft 565 to rotate also. The spinning brake shaft 565 causes the rotors 620, 621, 622, 623, 624, 625 to spin.

In a "free wheel" mode, where it is desired to remove the braking force from the disc assembly 550, an electrical current is applied to the solenoid 555. The solenoid 555 converts the electrical current into a mechanical linear force, which is demonstrated by the linear movement of the solenoid plunger 557. The solenoid plunger 557 acts upon the pressure plate 545, which in turn acts on the wave spring 540 to oppose it. This relieves the brake force and allows the idler gear 310 to move freely. In this mode, the solenoid 555 exerts a force that is equal to that of the wave spring 540. Consequently, the wave spring force is not transmitted to the disc brake assembly 550, allowing the rotors 620-625 to rotate freely.

In a "braking" mode, where it is desired to apply a braking force onto the disc assembly 550, the solenoid 555 is deactivated by removing the electrical current therefrom (in part or completely). As a result, the wave spring 540 force passes through the pressure plate 545 and compresses all the rotors 620-625 together against their corresponding stators 610-614, resulting in a braking action.

The wave spring 540 always pushes against the pressure plate 545. The difference between the two states is where the spring force ends up. In the "braking" mode, the spring force runs through all the brake discs of the brake disc assembly 550. In the "free wheel" mode, the spring force ends up cancelled by the solenoid 555. In both modes, the spring force is transmitted through the pressure plate 545.

Figure 7:
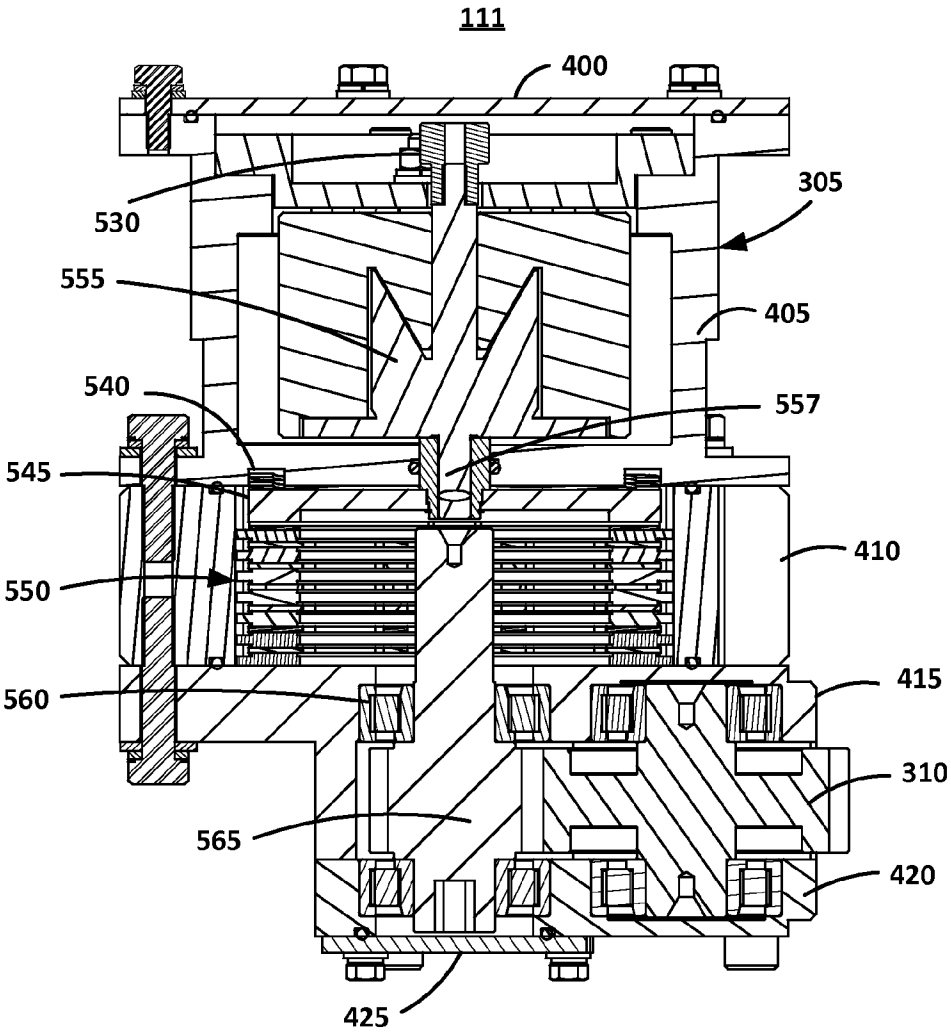
FIG. 7 is a front view of the recoil brake of FIG. 5, showing a solenoid in an activated state.
Figure 8:
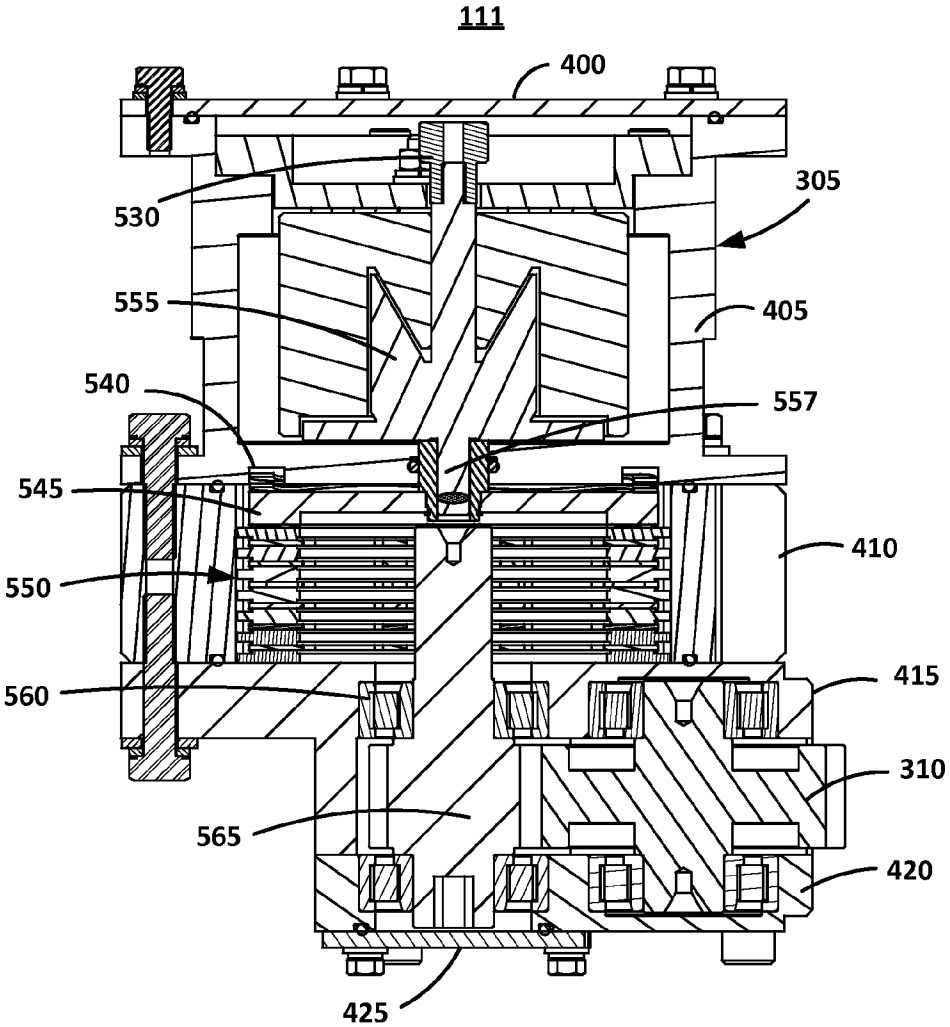
FIG. 8 is another view of the recoil brake of FIG. 7, showing the solenoid in a deactivated state.

FIGS. 7 and 8 illustrate the operation of the recoil brake of FIGS. 4 and 5, showing the solenoid 555 in an activated state and a deactivated state, respectively. When activated, the solenoid 555 exerts a force on the pressure plate 545, pulling it upward and cancelling the force exerted by the wave spring 545.

With reference to FIG. 7, based upon the recoil velocity, projectile temperature, and the weapon (5) cant data, the controller 200 (FIG. 11) will be able to determine the amount of braking required for the existing firing conditions. During normal firing conditions, where the recoil brake 111 is not needed, the controller 200 will fully activate the solenoid 555, reducing the braking force close to zero. To this end, the activation of the solenoid 555, causes the solenoid plunger 557 to be pull the pressure plate 545 upwardly, thus relieving the wave spring force from the disc assembly 550. When firing is carried out in extreme conditions, such as a cold temperatures (e.g., −45° F.) and/or negative cant (e.g., −20 degrees), the controller 200 will utilize tabulated data to apply the appropriate braking force during forward motion of the weapon 5, to ensure that the weapon 5 latches during the recoil system (200) rearward stroke. When a late ignition occurs, the controller 200 will utilize a feedback control loop to slow the rearward motion of the recoiling mass 20, so as to prevent weapon damage from occurring. To this end, a proportionate current is fed to the solenoid 555, so that the solenoid 555 is deactivated (or de-energized), at least in part.

Consequently, by using the sensors data in real time with a variable recoil brake 111, the active control recoil system 100 is able to solve issues with situational firing conditions that have plagued soft-recoil weapons since their inception.

Figure 9:
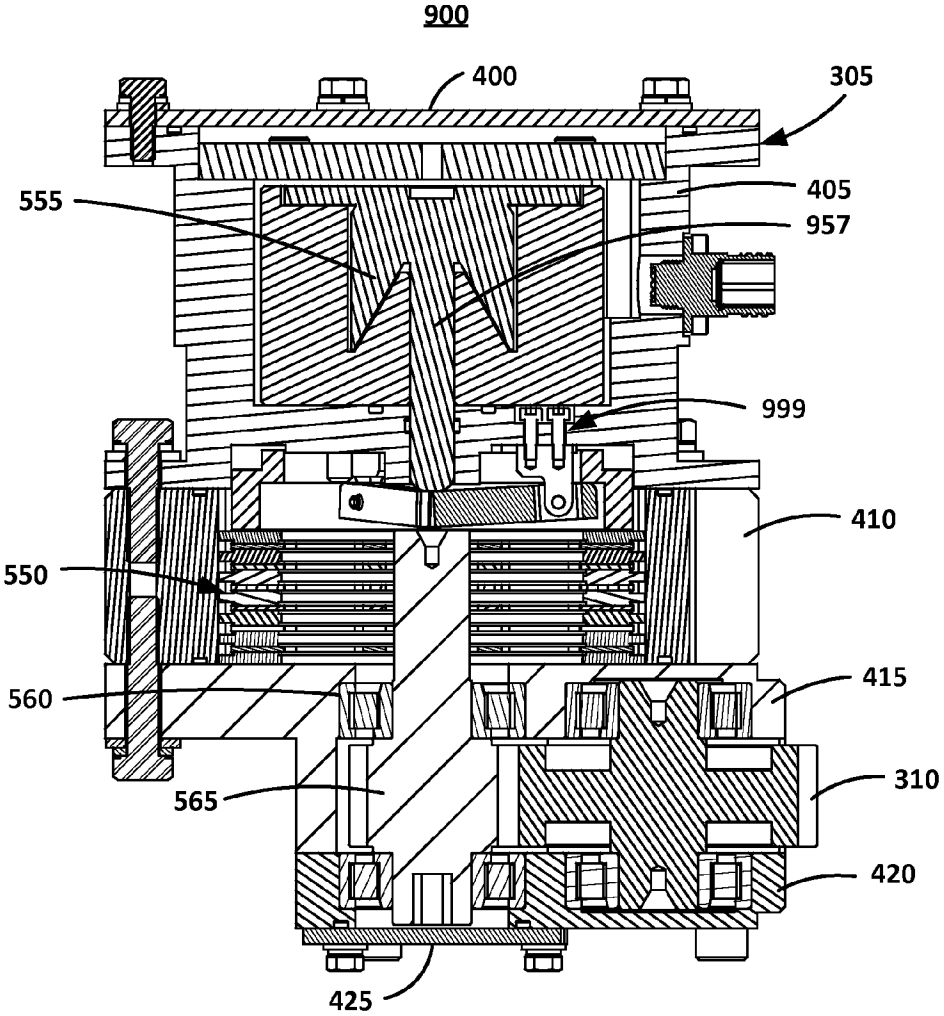
FIG. 9 is a front cross-sectional view of another embodiment of the recoil brake of FIG. 4, showing an inverted solenoid in an activated state.
Figure 9A:
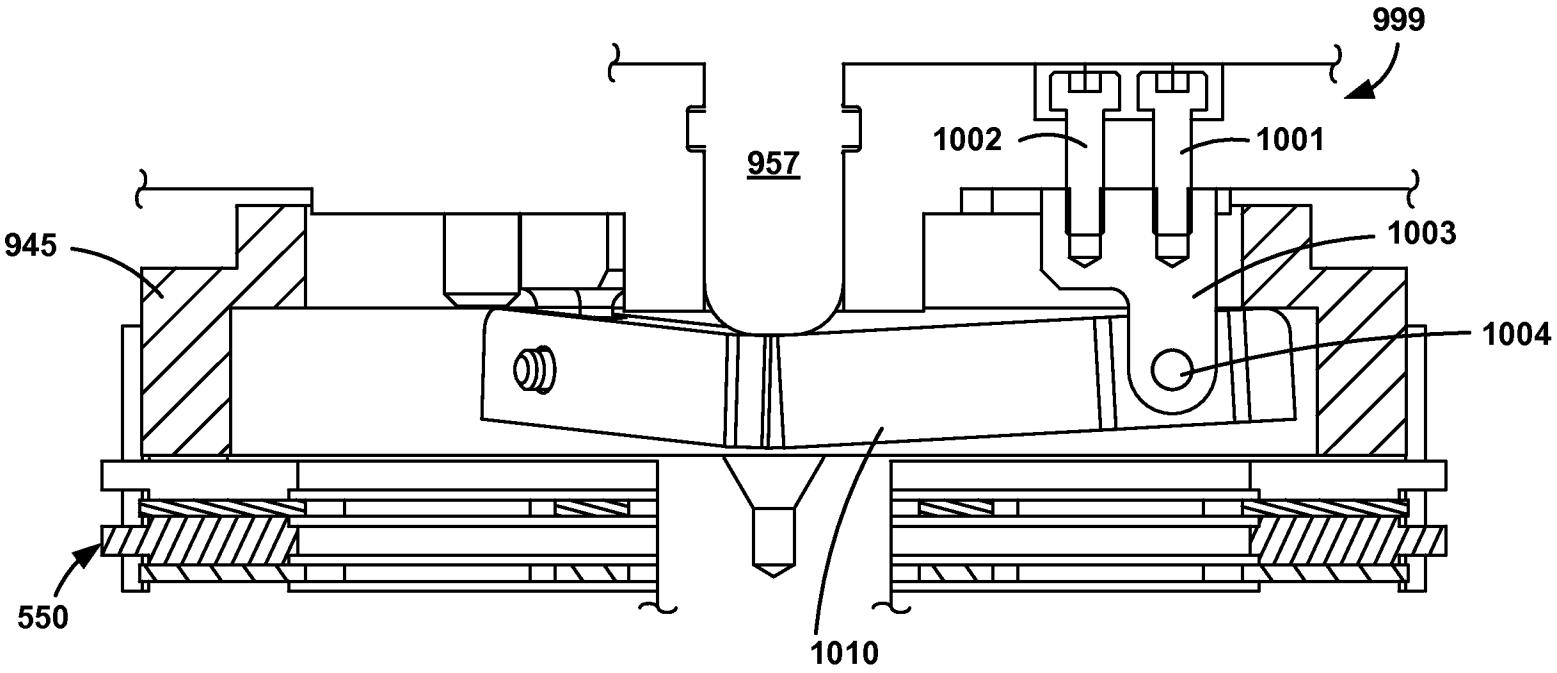
FIG. 9A is a greatly enlarged sectional view of a lever assembly that forms part of the recoil brake of FIG. 9.
Figure 10:
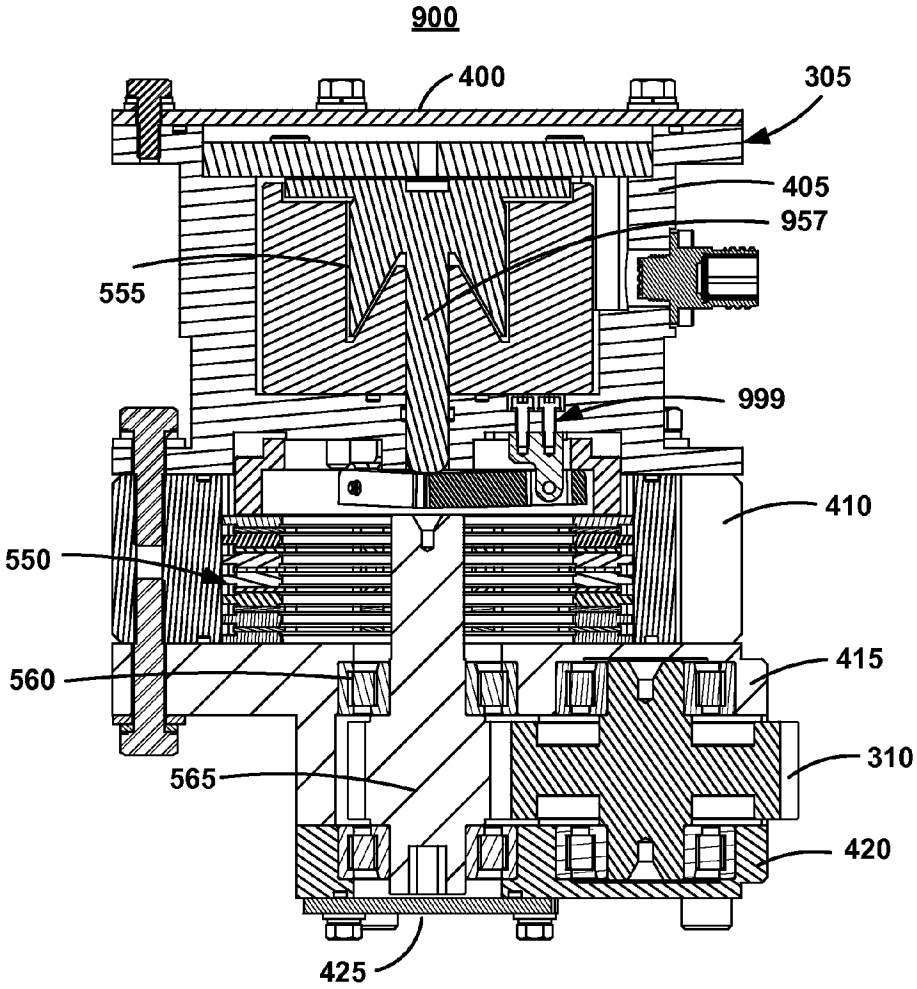
FIG. 10 is another view of the recoil brake of FIG. 9, showing the inverted solenoid in a deactivated state.

FIGS. 9, 9A, and 10 represent another embodiment of the recoil brake 111 of FIG. 4, showing an inverted solenoid in an activated state and a deactivate state, respectively. The recoil brake 900 of FIGS. 9, 9A, and 10 includes several components that are similar to those of the recoil brake 111. These common components are designated in FIGS. 9, 9A, and 10 by the same numeral references for ease of identification.

One of the main structural differences between the recoil brake 900 and the recoil brake 111 is that the solenoid 555 is inverted in the recoil brake 900. In the recoil brake 111 when the solenoid 555 is activated, the solenoid plunger 557 moves along the upward direction. In the recoil brake 900 when the solenoid 555 is activated, its plunger 957 moves along the downward direction, to engage a lever assembly 999.

The lever assembly 999 is generally formed of three levers 1010, three clevis eyes (1003) and three clevis pins (1004). The clevis eyes are fixed by two screws (1001 and 1002). The lever arm 1010 pivots about the pivot pin 1004 when it is pushed in the downward direction by the solenoid plunger 957. When the solenoid 555 is activated, it applies a force on the three levers 1010, which, in turn, push up on the pressure plate 945 to relieve the disc assembly 550, allowing the rotors 620-625 to rotate freely. When the levers 1010 move, they pivot about the pivot pin 1004, which is held in place by the clevis eye 1003. As a result, the spring force is opposed by the solenoid via the levers and pressure plate is removed from the friction discs.

When the solenoid 555 is deactivated, the three levers 1010 stop opposing the wave spring 540, and the wave spring load is transmitted to the brake disc assembly 550 to generate the braking torque. Although the motion of the solenoid 555 is reversed relative to the previous embodiment, it still functions the some way; activating the solenoid 555 turns the brake off, while deactivating the solenoid 555 turns the brake on.

Generally, a solenoid is limited in term of the amount of force it can apply, e.g., 170 pounds of force. In the setup of recoil brake 111, the axial force applied to the disc assembly 550 is limited to maximum output of the solenoid 555. However, the recoil brake 900 uses a lever assembly 999 to provide a mechanical advantage to the solenoid 555 opposing the wave spring 540. As a result, the allowable wave spring force is the solenoid force multiplied by the mechanical advantage, e.g. 170 lbf*4. Consequently, the braking capacity is increased by the mechanical advantage of the lever assembly 999 (minus any losses due to friction in the lever mechanism).

FIG. 11 illustrates the operation of the active recoil control system 100. The active recoil control system 100 uses multiple sensors 222 in combination with the solenoid controlled multi-disc brake 111 or 900, to adjust the weapon recoil. The sensors 222 include for example, an encoder to provide the recoil velocity, an infrared temperature sensor to measure the round temperature prior to firing, and an Inertial Navigation Unit (INU) to determine the weapon cant.

Using outputs from these sensors 222, the controller 200 is able to both predict and react to the recoiling mass 20 performance, and to apply the required braking force, in order to compensate for anticipated or actual variations. Feedback from the sensors 222 allows the active recoil control system 100 to adjust braking during the recoil stroke in order to optimize the weapon performance. The active recoil control system 100 is now able to eliminate the two major performance and design issues associated with soft recoil weapons, namely failure to latch and managing excess firing loads.

Figure 12:
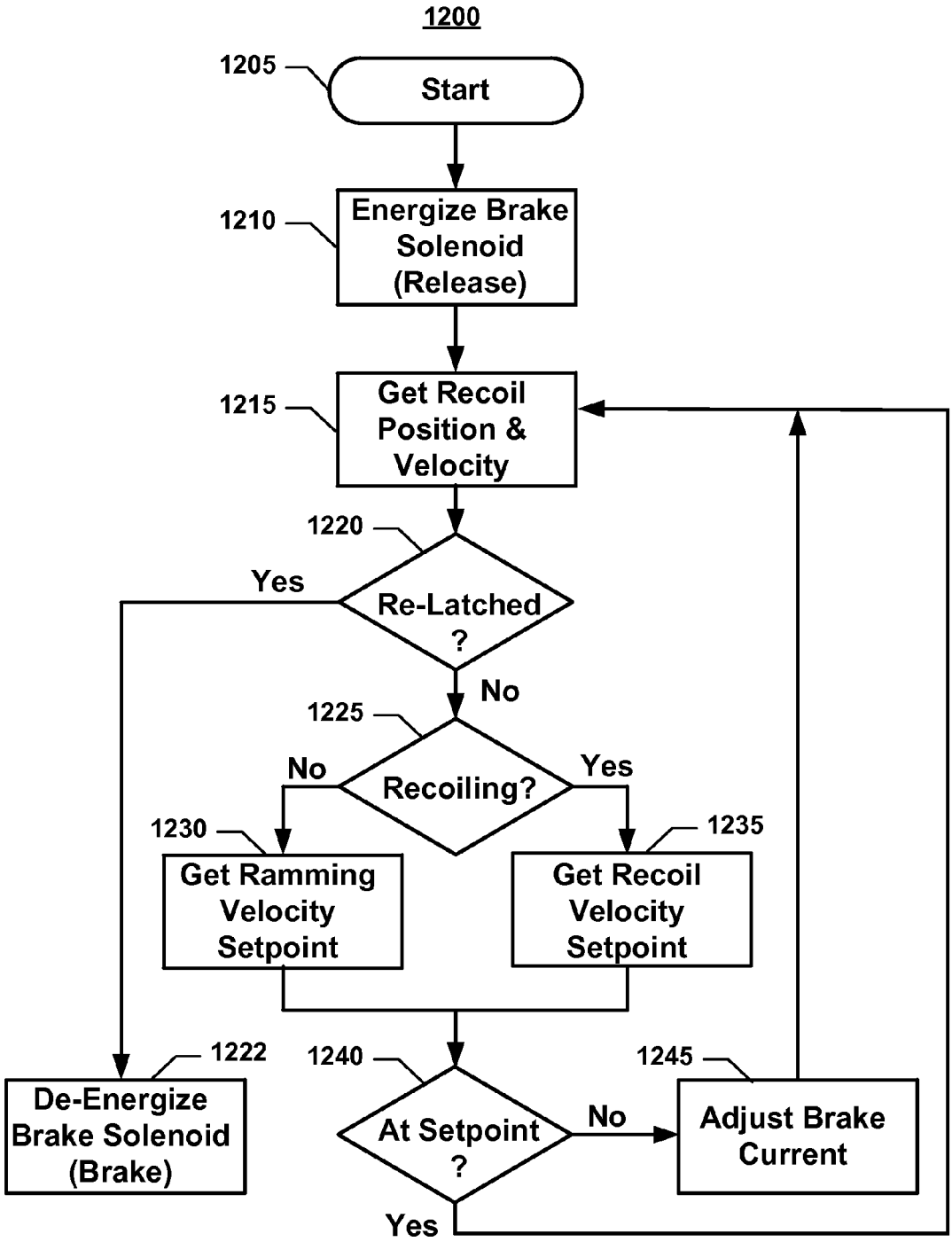
FIG. 12 is a flow chart illustrating the method of operation of a controller that forms part of the active recoil control system of FIG. 11.

FIG. 12 is a flow chart illustrating an exemplary method of operation 1200 of the controller 200 of FIG. 11. The method 1200 starts at 1205 by initializing the weapon 5 for firing. At step 1205, the method energizes the solenoid 555 to release the recoil brake 111. At step 1210, after firing begins, the controller 200 collects the recoil position and velocity of the recoiling mass 20.

At step 1220, the method 1200 inquires whether the recoiling mass 20 is relatched, that is if the gun 30 has returned to its starting position. If it has, then the controller 200 deenergizes the solenoid 555 causing it to apply a braking force. If, on the other hand, it is determined at step 1220 that the recoiling mass 20 has not relatched, then the process 1200 further inquires at step 1225 if the recoiling mass 20 is still recoiling.

If it is determined that the recoiling mass 20 is not recoiling, then the process 1200 calculates, at step 1230, the ramming velocity setpoint using for example, the round temperature, the round charge and the weapon cant weapon attitude, temperature, round height, the charge height, and other parameters (FIG. 11). If, on the other hand, it is determined that the recoiling mass 20 is recoiling, then the controller 200 calculates the recoil velocity setpoint, at step 1235.

The process 1200 then proceeds to step 1240 where it inquires if the recoiling mass 20 is at the proper setpoint. If it is, then the process 1200 loops back to step 1215 and follows the remaining steps as described earlier. If, however, it is determined that the recoiling mass 20 is not at the proper setpoint, then the controller 200 adjusts the brake current in order to cause the recoil brake 111 to apply the desired appropriate braking force on the recoiling mass 20.

It is to be understood that the phraseology and terminology used herein with reference to device or element orientation (such as, for example, terms like "front", "back", "up", "down", "top", "bottom", "forward", "rearward", and the like) are only used to simplify the description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. An active recoil control system for adjusting a weapon recoil, wherein a weapon is provided with a recoiling mass, comprising:

a multi-disc brake that generates a braking load;

a solenoid that controls operation of the multi-disc brake, for adjusting the weapon recoil;

a rack gear is mounted on the recoiling mass, to permit the braking load to be transmitted to the recoiling mass;

wherein the multi-disc brake includes:

a brake shaft;

a disc assembly comprised of stators and rotors, wherein as the disc assembly is subjected to an axial load, a torque is applied on the brake shaft; and a spring that applies a force to a pressure plate;

wherein the pressure plate selectively transmits the spring force to the disc assembly, causing the brake to apply a damping force to the recoiling mass; and wherein the solenoid selectively opposes the spring force via the pressure plate, to relieve the spring force transmitted to the disc assembly, in order to allow the brake shaft to spin freely.

2. The active recoil control system of claim 1, further comprising a recoil cylinder.

3. The active recoil control system of claim 1, further comprising a plurality of sensors that generates outputs reflective of sensed inputs; and a controller that uses the outputs of the sensors to predict and react to a recoiling mass performance; and to apply a required braking force, in order to compensate for any or more of anticipated variations in the recoiling mass performance and actual variations in the recoiling mass performance.

4. The active recoil control system of claim 1, wherein the brake adjusts the damping force during recoil strokes of the weapon.

5. The active recoil control system of claim 4, wherein the brake further includes an idler gear that mates with the rack gear to covert a linear motion of the recoil strokes into a rotary motion of the brake.

6. The active recoil control system of claim 1, wherein the brake adjusts the damping force during counter-recoil strokes of the weapon.

7. The active recoil control system of claim 1, wherein the solenoid includes a plunger; and wherein the solenoid plunger engages the pressure plate.

8. The active recoil control system of claim 7, wherein the solenoid plunger engages a lever assembly; and wherein the lever assembly acts on the pressure plate.

9. The active recoil control system of claim 8, wherein the lever assembly includes three levers that act on the pressure plate.

10. The active recoil control system of claim 9, wherein the lever arm includes a pivot pin; and wherein the lever arm pivots around the pivot point as it is pushed in predetermined direction by the solenoid plunger.

11. The active recoil control system of claim 10, wherein upon activation, the solenoid applies a force on the three levers, causing the three levers to push against the pressure plate to relieve the disc assembly, allowing the rotors to rotate freely.

* * * * *